United States Patent [19]

Ausnit et al.

[11] Patent Number: 4,890,935

[45] Date of Patent: Jan. 2, 1990

[54] LEAK RESISTANT ZIPPER

[75] Inventors: Steven Ausnit, New York; Paul Tilman, New City, both of N.Y.

[73] Assignee: Minigrip, Inc., Orangeburg, N.Y.

[21] Appl. No.: 232,751

[22] Filed: Aug. 16, 1988

[51] Int. Cl.[4] ..... A44B 19/28; A44B 19/32; B65D 33/16

[52] U.S. Cl. ..... 383/59; 383/64; 24/390; 24/399; 24/435

[58] Field of Search ..... 24/389, 384, 399, 435, 24/390, 418; 383/59, 63, 64, 65, 97; 190/903

[56] References Cited

U.S. PATENT DOCUMENTS

| | | | |
|---|---|---|---|
| 2,321,926 | 6/1943 | Marinsky et al. | 24/384 |
| 2,753,609 | 7/1956 | Gossner | 24/384 |
| 2,841,851 | 7/1958 | Van Amburg et al. | 24/384 |
| 2,869,207 | 1/1959 | Bernstein | 24/389 |

FOREIGN PATENT DOCUMENTS

| | | | |
|---|---|---|---|
| 1079480 | 11/1954 | France | 383/63 |
| 300325 | 10/1954 | Switzerland | 24/399 |
| 812842 | 5/1959 | United Kingdom | 24/389 |

*Primary Examiner*—Stephen Marcus
*Assistant Examiner*—Jes F. Pascua
*Attorney, Agent, or Firm*—Kane, Dalsimer, Sullivan, Kurucz, Levy, Eisele and Richard

[57] ABSTRACT

A leak resistant toothless plastic zipper is provided. The closed end of the zipper fused together and/or is secured in position by a clamp from which a gasket extends toward the open end of the zipper to engage with the zipper slider in sealing the gap that would otherwise form at the zipper closed end. A hook is provided to secure the tab of the zipper slider in sealing engagement with the gasket when the slider is at the closed end. The gasket may be disposed about the zipper elements or interposed between the elements. A bag incorporating such a zipper is also disclosed.

26 Claims, 2 Drawing Sheets

LEAK RESISTANT ZIPPER

The present invention relates to plastic zipper bags and in particular to an improved zipper construction which renders such bags highly leak resistant.

Toothless plastic zippers such as disclosed in U.S. Pat. No. 2,613,421, 3,049,779, 3,054,434 and others are extensively used in a wide variety of products. Such zippers are commonly formed of extruded plastic zipper strips containing longitudinally extending profile elements configured to matingly engage with one another. A typical profile is depicted in U.S. Pat. No. 2,613,421 or U.S. Pat. No. 3,054,434. The profiles may be urged into and out of engagement by means of a slider in a manner similar to that of conventional toothed zippers. Typical slide arrangements are depicted in U.S. Pat. Nos. 2,867,877 and 3,115,689, 3,160,934 and others.

The zippers per se may be rendered substantially leak resistant over their entire length by properly dimensioning and extruding the profiles to close tolerances as well as by choosing appropriate materials to obtain a tight sealing engagement between the profile elements such as in U.S. Pat. No. 3,918,131 or U.S. Pat. No. 3,440,696. A problem exists, however in completely closing one of the ends of the zipper. At the open end of the zipper (i.e. the end to which the slide must be drawn to open the bag) the zipper profiles are tightly pressed together and fused together to obtain a permanent seal to which the slider may be drawn. Since this stop is beyond the closing mouth of the slider the zipper profile elements remain interlocked even when the slider abuts the end stop. However, at the closed end of the zipper (i.e. the end to which the slide must be drawn to close the bag) a problem develops in that a gap inevitably forms between the leading end of the slider and the end stop which holds the ends of the zipper strips together. As a result, the use of such zippers is not encouraged where leak resistance is an important characteristic.

One use for zippers of the type above described is as a closure for body bags. In recent years, the containment of body fluids by the body bag has become essential to prevent contamination and possible infection of the handlers. Accordingly, a need has arisen for a highly leak resistant plastic toothless zipper.

In view of the above, it is the principal object of the present invention to provide an improved, highly leak resistant toothless zipper.

A further object of the present invention is to provide such a zipper which utilizes generally conventional zipper strips, profile constructions, slides and the like and hence may be extruded on conventional zipper forming equipment.

A still further object is to provide a zipper which may be economically and competitively priced.

SUMMARY OF THE INVENTION

The above and other beneficial objects and advantages are attained in accordance with the present invention by providing a zipper comprising a first strip containing a continuous, longitudinally extending profile element and a second strip containing a continuous longitudinally extending profile element adapted to mate with the first strip profile. The ends of the strips are sealed together and/or retained in mating engagement with each other by means of clamps or end stops positioned at the open and closed ends of the zipper. A slider member is provided on the zipper having portions positioned about and between the profile elements and configured to guide the profile elements into engagement when moved from the zipper open end toward the zipper closed end. The end stop at the zipper closed end is provided with gasket means which extend beyond the end stop toward the zipper open end to sealingly engage with the slider member.

The gasket means is preferably formed of a closed cell foam material sufficiently resilient so as to securely engage and seal against the zipper slider. The gasket may extend between the profile elements and/or surround the profile elements. A clamp arrangement is provided to secure the slider in sealing engagement with the gasket when the zipper is fully closed.

DETAILED DESCRIPTION OF THE PREFERRED EMBODIMENT

Figure 1:
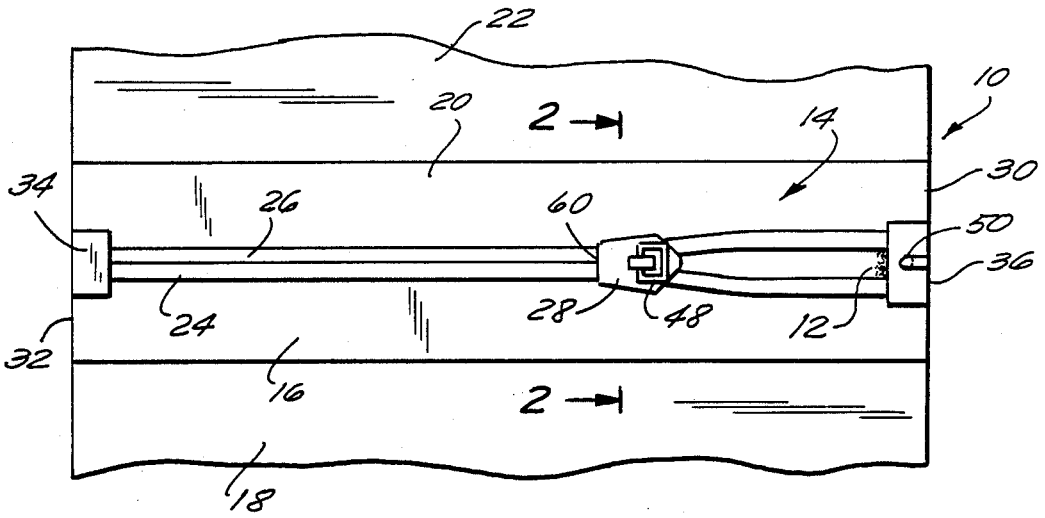
FIG. 1 is an exaggerated simplified view of a reclosable bag incorporating a zipper in accordance with the present invention wherein the zipper components are greatly exaggerated for clarity.
Figure 2:
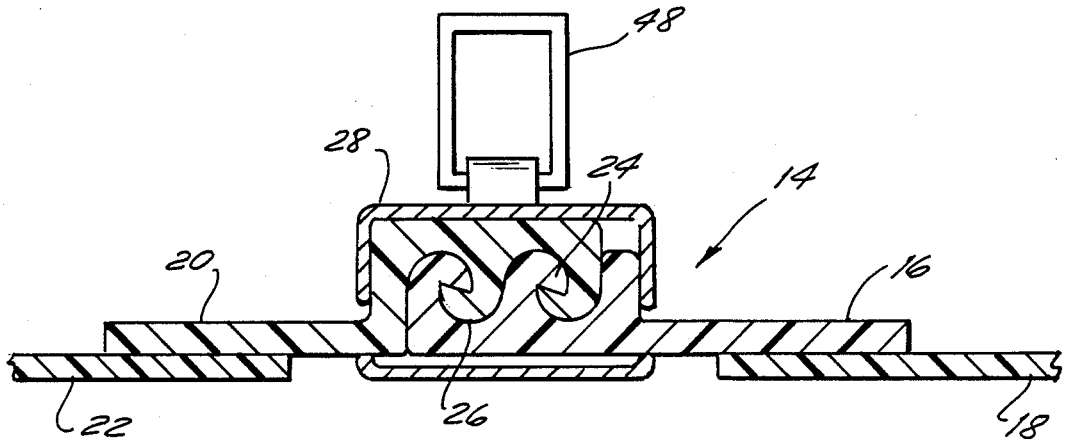
FIG. 2 is a sectional view taken along lines 2—2 of FIG. 1.

Reference is now made to the drawings and to FIGS. 1 and 2 in particular wherein a plastic bag 10 is depicted provided with an opening 12 designed to be closed by a zipper 14. The details of the zipper 14 are shown in FIG. 2. As will be noted, the zipper 14 includes a first zipper strip 16 which is bonded to one side 18 of the bag body opening and a second zipper strip 20 bonded to the other side 22 of the bag body opening. Zipper strip 16 includes an extruded profile 24 while zipper strip 12 includes an extruded profile 26. In the depicted embodiment, the profiles 24 and 26 are identical with each other. Thus, each of the profiles includes a pair of hook-shaped projections intertwined between a substantially identical pair of hook-shaped recesses. By extruding the projections and recesses to close tolerances, the zipper profiles may be brought into a tight sealing engagement with each other as depicted in FIG. 2. A slider 28 is provided which includes portions that fit over and between the profiles and is designed so that when the slider is drawn toward the closed end 30 of the zipper the zipper elements engage being closed by the slider mouth 60, whereas when the slide is drawn to the open end 32 of the bag the zipper elements are disengaged by the slider wedge 61. Such zippers and slides are, of course, well known in the art.

End stops 34 and 36 are provided at the opened and closed ends of zipper 14 respectively. The end stops are usually attached after the zipper ends have been fused together. Such end stops comprise clamps which when closed serve to engage the zipper and hold the ends of the zipper in mating engagement and to retain the zipper ends in such engagement regardless of the position of slide 28. Such end stops conventionally consist of a clam-shaped plastic or metal member which retains the zipper between its jaws in the closed position.

Figure 3:
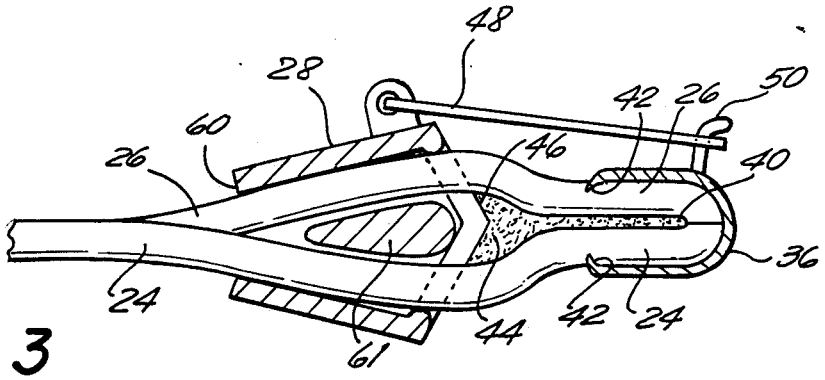
FIG. 3 is an enlarged elevational sectional view of a first embodiment of a zipper end stop in accordance with the present invention.
Figure 4:
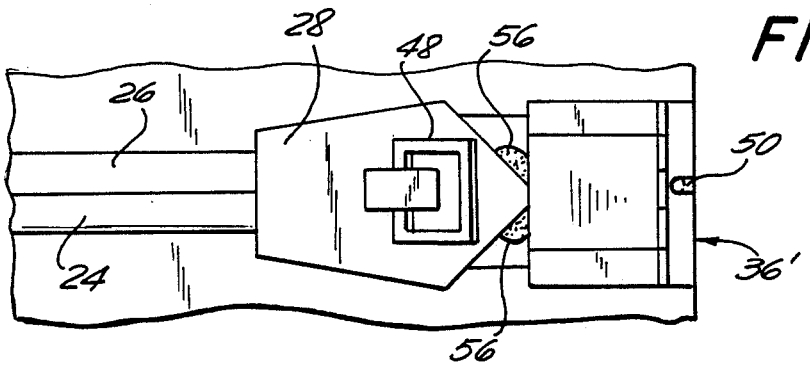
FIG. 4 is a view similar to FIG. 3 of a second embodiment of a zipper end stop in accordance with the present invention; and, FIG. 5 is a perspective view of the zipper end stop element of FIG. 4.
Figure 5:
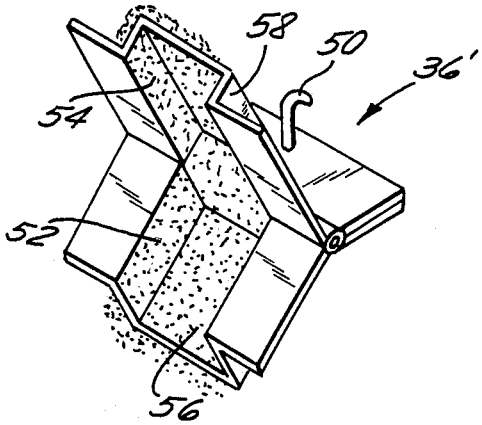

In FIG. 3 a first embodiment of the present invention is depicted wherein a foam plastic gasket material 38 is positioned between the profile elements 24 and 26 either by fusing these profiles together and/or extending from the end stop 36 toward the open end of the bag. The captured end 40 of the gasket material is thus securely retained in position between the ends of the zipper strip profiles 24 and 26 either by fusing these profiles together and/or by end stop 36 which in turn is securely held in position by a pair of barbs 42 which bite into the plastic zippers. The opposite end 44 of the gasket material is free and extends into the space between the profiles at the closing end of the bag. As a result, when the leading edge 46 of the slider is brought into engagement with the gasket material a seal is formed thereby eliminating the gap which otherwise would form in the area occupied by the free end 44 of the gasket. The slider tab 48 or an extension thereof can be provided on the slide to engage hook 50 attached to the end stop 36 to thereby hold the slide in position and maintain the seal. An alternative end stop 36' is depicted in FIG. 5. The clamp comprises a pair of generally rectangular receptacles 52,54 joined at a hinge and provided with an opening opposite to the hinge. The receptacles and hinge may conveniently be formed from a single piece of metal or plastic. In this construction the interior surfaces of the top and bottom receptacles 52 and 54 of end stop 36' are lined with the foam material 56. As in the embodiment of FIG. 3, the foam material extends outwardly beyond the end stop toward the open end of the zipper. As with the embodiment of FIG. 3, when the slider 28 is drawn against the foam material 56 extending beyond the edge of the end stop, slide a seal is formed completely closing the gap between the end stop and forward end of the slider.

By sealing the gap between the slide and the close-end stop 36 or 36' the closed zipper and hence the attached bag are rendered highly leak resistant. By extruding the zipper to close tolerances so that the profiles sealingly engage, carefully bonding the zipper to the body bag, and ensuring that sufficient gasket material extends beyond the end stop to engage the slide a substantially leak proof bag may be formed.

Having thus described the invention, what is claimed is:

1. A leak resistant zipper comprising:

a first strip including a first longitudinally extending profile element;

a second strip including a second longitudinally extending profile element configured to matingly engage said first profile element; a slider member having portions positioned about and between said profile elements and configured to guide said profile elements into engagement when moved from an open end of said zipper toward a closed end of said zipper;

clamp means at said zipper closed end retaining said first and second profile elements in engagement; and, gasket means extending from and beyond said clamping means toward said zipper open end for sealingly engaging with said slider member when said slider member is drawn against said gasket wherein said gasket comprises a resilient member disposed about said first and second profile elements and retained in position by said clamp means.

2. The invention in accordance with claim 1, wherein said slider member includes a forward portion directed toward said zipper closed end and means for retaining said slider forward portion in sealing engagement with said gasket means.

3. The invention in accordance with claim 2, wherein said retaining means comprises a hook element for releasably securing said slider to said clamp means.

4. The invention in accordance with claim 1, wherein said gasket comprises a closed cell foam material.

5. The invention in accordance with claims 1, 2, 3 or 4 wherein said clamp means comprises a pair of receptacles joined at a hinge and having an opening opposite said hinge, said receptacles being lined with a foam material extending beyond said opening and defining said gasket.

6. The invention in accordance with claims 1, 2, 3 or 4 wherein said first and second strips are formed of a plastic material and said clamp means is formed by fusing said profile elements together.

7. A plastic bag formed of a plastic material and having an opening therein with a first zipper strip including a first longitudinally extending profile extending along one side of said opening;

a second zipper strip including a second longitudinally extending profile element extending along the opposite side of said opening, said second profile element being configured to matingly engage said first profile element, said first and second zipper strips forming a zipper;

a slider member having portions positioned about and between said profile elements and configured to guide said profile elements into engagement when moved from an open end of said zipper toward a closed end of said zipper;

clamp means at said zipper closed end retaining said first and second profile elements in engagement; and gasket means extending from said clamp means toward said zipper open end for sealingly engaging with said slider member when said slider member is drawn against said gasket wherein said gasket comprises a resilient member disposed about said first and second profile elements and retained in position by said clamp means.

8. The invention in accordance with claim 7, wherein said slider member includes a forward portion directed toward said zipper closed end and means for retaining said slider forward portion in sealing engagement with said gasket.

9. The invention in accordance with claim 8, wherein said retaining means comprises a hook element for releasably securing said slider to said clamp.

10. The invention in accordance with claim 7, wherein said gasket comprises a closed cell foam material.

11. The invention in accordance with claims 7, 8, 9 or 10 wherein said fist and second zipper strips are formed of a plastic material and said clamp means is formed by fusing said profile elements together.

12. The invention in accordance with claims 7, 8, 9 or 10 wherein said clamp means comprises a pair of receptacles joined at a hinge and having an opening opposite said hinge, said receptacles being lined with a foam material extending beyond said opening and defining said gasket.

13. A leak resistant zipper comprising:

a first strip including a first longitudinally extending profile element;

a second strip including a second longitudinally extending profile element configured to matingly engage said first profile element; a slider member having portions positioned about and between said profile elements and configured to guide said profile elements into engagement when moved from an open end of said zipper toward a closed end of said zipper;

clamp means at said zipper closed end retaining said first and second profile elements in engagement wherein said clamp means comprises a pair of receptacles joined at a hinge and having an opening opposite said hinge, said receptacles being lined with a foam material extending beyond said opening and defining said gasket; and, gasket means extending from and beyond said clamp means toward said zipper open end for sealingly engaging with said slider member when said slider member is drawn against said gasket.

14. The invention in accordance with claim 13, wherein said slider member includes a forward portion directed toward said zipper closed end and means for retaining said slider forward portion in sealing engagement with said gasket means.

15. The invention in accordance with claim 14, wherein said retaining means comprises a hook element for releasably securing said slider to said clamp means.

16. The invention in accordance with claim 13, wherein said gasket comprises a closed cell foam material.

17. The invention in accordance with claims 13, 14, 15, or 16 wherein said gasket means comprises a resilient member positioned between said profiles and retained in position by said clamp means.

18. The invention in accordance with claims 13, 14, 15 or 16, wherein said gasket comprises a resilient member disposed about said first and second profile elements and retained in position by said clamp means.

19. The invention in accordance with claims 13, 14, 15 or 16, wherein said first and second strips are formed of a plastic material and said clamp means is formed by fusing said profile elements together.

20. A plastic bag formed of a plastic material and having an opening therein with a first zipper strip including a first longitudinally extending profile extending along one side of said opening;

a second zipper strip including a second longitudinally extending profile element extending along the opposite side of said opening, said second profile element being configured to matingly engage said first profile element, said first and second zipper strips forming a zipper;

a slider member having portions positioned about and between said profile elements and configured to guide said profile elements into engagement when moved from an open end of said zipper toward a closed end of said zipper;

clamp means at said zipper closed end retaining said first and second profile elements in engagement wherein said clamp means comprises a pair of receptacles joined at a hinge and having an opening opposite said hinge, said receptacles being lined with a foam material extending beyond said opening and defining said gasket; and gasket means extending from said clamp means toward said zipper open end for sealingly engaging with said slider member when said slider member is drawn against said gasket.

21. The invention in accordance with claim 20, wherein said slider member includes a forward portion directed toward said zipper closed end and means for retaining said slider forward portion in sealing engagement with said gasket.

22. The invention in accordance with claim 21, wherein said retaining means comprises a hook element for releasably securing said slider to said clamp.

23. The invention in accordance with claim 20, wherein said gasket comprises a closed cell foam material.

24. The invention in accordance with claims 20, 21, 22 or 23, wherein said gasket means comprises a resilient member positioned between said profiles and retained in position by said clamp means.

25. The invention in accordance with claims 20, 21, 22 or 23, wherein said gasket comprises a resilient member disposed about said first and second profile elements and retained in position by said clamp means.

26. The invention in accordance with claims 20, 21, 22 or 23 wherein said first and second zipper strips are formed of a plastic material and said clamp means is formed by fusing said profile elements together.

* * * * *